US010330060B2

(12) United States Patent
Hayashi

(10) Patent No.: US 10,330,060 B2
(45) Date of Patent: Jun. 25, 2019

(54) GASOLINE FUEL SUPPLY SYSTEM

(71) Applicant: DENSO CORPORATION, Kariya, Aichi-pref. (JP)

(72) Inventor: Norihiro Hayashi, Kariya (JP)

(73) Assignee: DENSO CORPORATION, Kariya (JP)

( * ) Notice: Subject to any disclaimer, the term of this patent is extended or adjusted under 35 U.S.C. 154(b) by 4 days.

(21) Appl. No.: 15/556,472

(22) PCT Filed: May 12, 2016

(86) PCT No.: PCT/JP2016/002332
§ 371 (c)(1),
(2) Date: Sep. 7, 2017

(87) PCT Pub. No.: WO2016/199348
PCT Pub. Date: Dec. 15, 2016

(65) Prior Publication Data

US 2018/0051663 A1 Feb. 22, 2018

(30) Foreign Application Priority Data

Jun. 10, 2015 (JP) ..... 2015-117802

(51) Int. Cl.
*F02M 37/00* (2006.01)
*F02M 37/06* (2006.01)
(Continued)

(52) U.S. Cl.
CPC ..... *F02M 37/0047* (2013.01); *F02M 37/06* (2013.01); *F02M 37/08* (2013.01);
(Continued)

(58) Field of Classification Search
CPC ..... F02M 37/06; F02M 37/08; F02M 45/06; F02M 59/34; F02M 39/005;
(Continued)

(56) References Cited

U.S. PATENT DOCUMENTS 6,192,864 B1 * 2/2001 Nishimura ..... F02D 41/3845 123/456
6,543,425 B2 * 4/2003 Mayer ..... F02M 37/041 123/495
(Continued)

FOREIGN PATENT DOCUMENTS

JP 11-324853 11/1999
JP 2002-364482 12/2002
(Continued)

OTHER PUBLICATIONS

International Search Report for PCT/JP2016/002332, dated Aug. 2, 2016, 4 pages.
(Continued)

*Primary Examiner* — Sizo B Vilakazi
(74) *Attorney, Agent, or Firm* — Nixon & Vanderhye P.C.

(57) ABSTRACT

A gasoline fuel supply system includes a feed pump part, an inline pump part, and a high-pressure pump part. The feed pump part includes a non-positive displacement electric pump, and pumps a gasoline fuel from a fuel tank and discharges at a feed pressure. The inline pump part includes a non-positive displacement mechanical pump, and pressurizes the gasoline fuel discharged from the feed pump part and discharges at a middle pressure. The high-pressure pump part includes a positive displacement mechanical pump, and pressurizes the gasoline fuel discharged from the inline pump part and discharges at a supply pressure to a fuel injection valve.

6 Claims, 7 Drawing Sheets

(51) Int. Cl.

| | |
|---|---|
| ***F02M 37/08*** | (2006.01) |
| ***F02M 45/06*** | (2006.01) |
| ***F02M 59/34*** | (2006.01) |
| ***F02M 39/00*** | (2006.01) |
| ***F02M 37/18*** | (2006.01) |
| ***F02M 59/02*** | (2006.01) |
| ***F02M 59/10*** | (2006.01) |
| ***F02M 59/36*** | (2006.01) |
| *F02M 63/02* | (2006.01) |

(52) U.S. Cl.
CPC ..... *F02M 37/18* (2013.01); *F02M 39/005* (2013.01); *F02M 45/06* (2013.01); *F02M 59/02* (2013.01); *F02M 59/102* (2013.01); *F02M 59/34* (2013.01); *F02M 59/366* (2013.01); *F02M 59/368* (2013.01); *F02M 63/027* (2013.01); *F02M 2200/315* (2013.01)

(58) Field of Classification Search
CPC .... F02M 37/0047; F02M 37/18; F02M 59/02; F02M 59/102; F02M 59/366; F02M 59/368; F02M 63/027; F02M 2200/315
See application file for complete search history.

(56) References Cited

U.S. PATENT DOCUMENTS

| | | | | |
|---|---|---|---|---|
| 9,328,708 | B2 * | 5/2016 | Boecking | F02D 33/006 |
| 10,190,508 | B2 * | 1/2019 | Lehman | F02M 37/22 |
| 2004/0211395 | A1 * | 10/2004 | Greco | F02D 41/064 123/497 |
| 2016/0138489 | A1 * | 5/2016 | Lamm | F02D 41/3082 123/446 |

FOREIGN PATENT DOCUMENTS

| | | |
|---|---|---|
| JP | 2010-133265 | 6/2010 |
| JP | 2013-050091 | 3/2013 |
| JP | 2014-005798 | 1/2014 |

OTHER PUBLICATIONS

Written Opinion of the ISA for PCT/JP2016/002332, dated Aug. 2, 2016, 6 pages.

* cited by examiner

GASOLINE FUEL SUPPLY SYSTEM

CROSS REFERENCE TO RELATED APPLICATION

This application is the U.S. national phase of International Application No. PCT/JP2016/002332 filed May 12, 2016, which designated the U.S. and claims priority to Japanese Patent Application No. 2015-117802 filed on Jun. 10, 2015, the entire contents of each of which are herein by reference.

TECHNICAL FIELD

The present disclosure relates to a gasoline fuel supply system.

BACKGROUND ART

A gasoline fuel supply system is conventionally well-known, which pumps up a gasoline fuel from a fuel tank and supplies the gasoline fuel to a fuel injection valve. The fuel injection valve directly injects the gasoline fuel into a cylinder of an internal-combustion engine.

Patent literature 1 discloses such a gasoline fuel supply system including a feed pump part and a high-pressure pump part. The feed pump part includes an electric pump, as a main component, which operates by being supplied with electric power, and pumps the gasoline fuel from the fuel tank to discharge at a feed pressure. The high-pressure pump part includes a positive displacement mechanical pump which operates in response to an output of an internal-combustion engine, as a main component. The high-pressure pump part pressurizes the gasoline fuel discharged from the feed pump part, and discharges the gasoline fuel at a supply pressure to a fuel injection valve. The supply pressure to the fuel injection valve can be raised to a pressure required for the direct injection of gasoline fuel, since the gasoline fuel supply system is equipped with both the feed pump part and the high-pressure pump part.

PRIOR ART LITERATURES

Patent Literature

Patent Literature 1 JP 2010-133265 A

SUMMARY OF INVENTION

However, in Patent Literature 1, there is a possibility of a bad influence on the fuel injection characteristic from the fuel injection valve, since the gasoline fuel is vaporized at the low-pressure side of the high-pressure pump part which receives heat from the internal-combustion engine. If the feed pressure from the electric pump is raised in order to control the vaporization, the power consumption will increase at the time of energizing the electric pump. Such an increase in the power consumption is not desirable in the viewpoint of energy-saving. Moreover, in Patent Literature 1, in case where the electric pump is a positive displacement pump, similarly to the mechanical pump, if the electric pump breaks down, the pumping of gasoline fuel itself becomes difficult. It is not desirable in the viewpoint of fail-safe.

It is an object of the present disclosure to provide a gasoline fuel supply system which can secure fuel injection characteristic, energy-saving and fail-safe.

According to an aspect of the present disclosure, a gasoline fuel supply system supplies a gasoline fuel to a fuel injection valve by pumping from a fuel tank so as to be directly injected by the fuel injection valve into a cylinder of an internal-combustion engine, and includes a feed pump part, an inline pump part, and a high-pressure pump part. The feed pump part includes a non-positive displacement electric pump which operates in response to receiving electric power, and pumps the gasoline fuel from the fuel tank and discharges at a feed pressure. The inline pump part includes a non-positive displacement mechanical pump which operates in response to receiving an output of the internal-combustion engine, and pressurizes the gasoline fuel discharged from the feed pump part and discharges at a middle pressure. The high-pressure pump part includes a positive displacement mechanical pump which operates in response to receiving the output of the internal-combustion engine. The high-pressure pump part pressurizes the gasoline fuel discharged from the inline pump part, and discharges the gasoline fuel at a supply pressure to the fuel injection valve.

The inline pump part pressurizes the gasoline fuel discharged from the feed pump part, and discharges at the middle pressure. Furthermore, the high-pressure pump part pressurizes the gasoline fuel discharged from the inline pump part; and discharges the gasoline fuel at the supply pressure to the fuel injection valve. Therefore, while the feed pressure of the gasoline fuel pumped from the fuel tank is restricted to be low in the feed pump part, the inline pump part can raise the middle pressure discharged to the low-pressure side of the high-pressure pump part. Here, the feed pump part includes the non-positive displacement electric pump which operates in response to a passage of electricity, and the inline pump part includes the non-positive displacement mechanical pump which operates in response to the output of the internal-combustion engine. Thereby, the power consumption can be reduced in the feed pump part in which the feed pressure is restricted low at the time of supplying electric power to the non-positive displacement electric pump, and the vaporization of gasoline fuel can be restricted in the inline pump part, in which the non-positive displacement mechanical pump uses the output of the internal-combustion engine. Therefore, the fuel injection characteristic can be secured while the energy can be saved.

If the non-positive displacement electric pump breaks down in the feed pump part, the inline pump part can supply the gasoline fuel to the high-pressure pump part, because the gasoline fuel is pumped from the fuel tank through the non-positive displacement electric pump which breaks down. Conversely, if the non-positive displacement mechanical pump breaks down in the inline pump part, the gasoline fuel discharged out of the fuel tank with the non-positive displacement electric pump in the feed pump part can be supplied to the high-pressure pump part through the non-positive displacement mechanical pump which breaks down. Therefore, the fail-safe system can be secured.

As mentioned above, it is possible to secure both the fuel injection characteristic, and the energy-saving and fail-safe properties.

Moreover, the inline pump part may have a check valve which regulates an adverse flow of the gasoline fuel discharged from the non-positive displacement mechanical pump.

Thereby, in the inline pump part, the adverse current of the gasoline fuel discharged from the non-positive displacement mechanical pump is regulated by the check valve. Therefore, at a time of dead soak when the internal-combustion engine is left in the halt condition, at the low-pressure side of the high-pressure pump part which receives heat from the internal-combustion engine, the vaporization can be controlled by maintaining the fuel pressure of gasoline fuel at the middle pressure. Therefore, the fuel injection characteristic can be secured in the internal-combustion engine when the internal-combustion engine is started after the dead soak.

DESCRIPTION OF EMBODIMENTS

Figure 1:
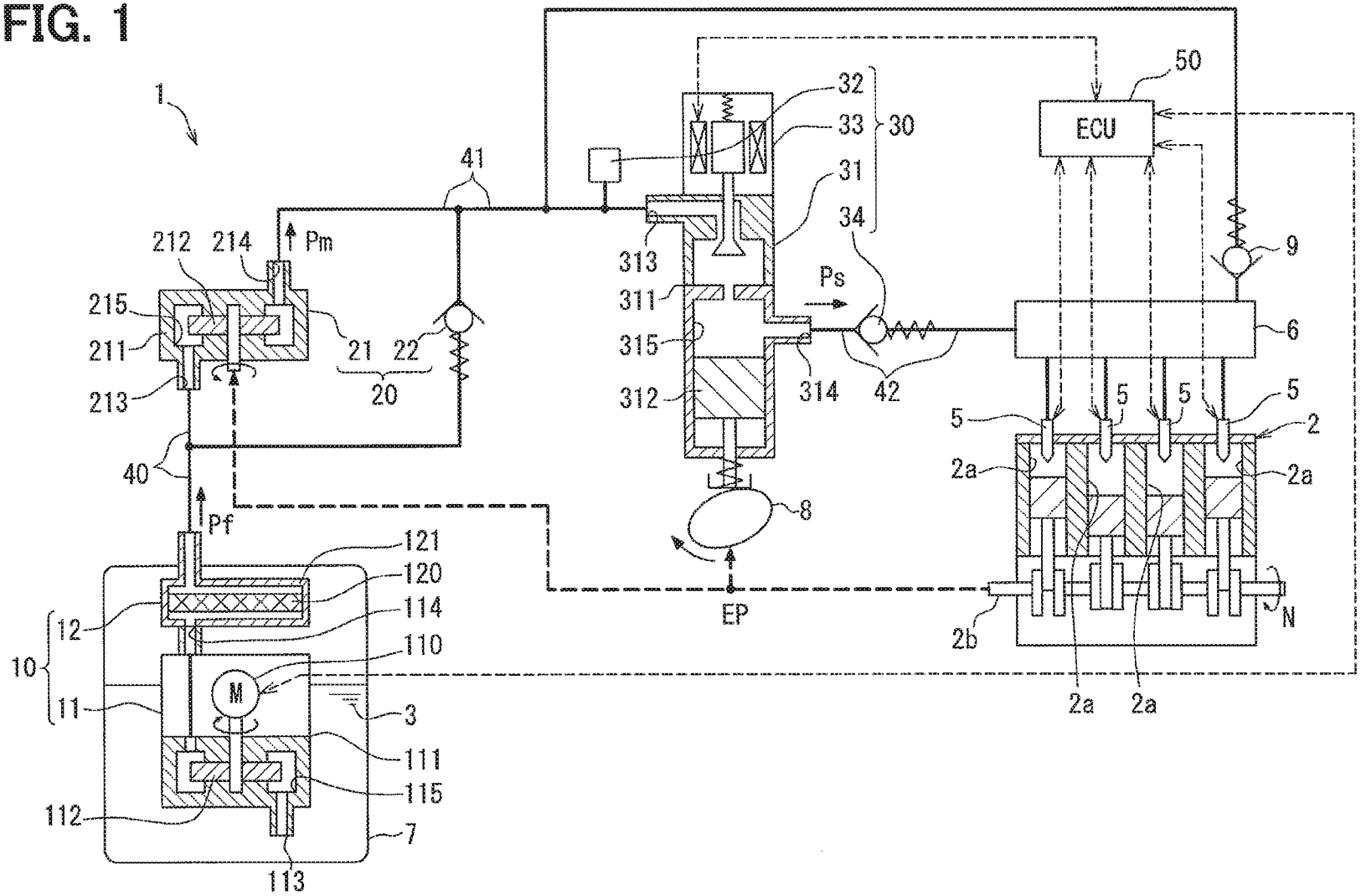
FIG. 1 is a diagram illustrating an internal-combustion engine and a gasoline fuel supply system according to a first embodiment.

Embodiments of the present disclosure will be described hereafter referring to drawings. In the embodiments, a part that corresponds to a matter described in a preceding embodiment may be assigned with the same reference numeral, and redundant explanation for the part may be omitted. When only a part of a configuration is described in an embodiment, another preceding embodiment may be applied to the other parts of the configuration. The parts may be combined even if it is not explicitly described that the parts can be combined. The embodiments may be partially combined even if it is not explicitly described that the embodiments can be combined, provided there is no harm in the combination.

First Embodiment

As shown in FIG. 1, a gasoline fuel supply system 1 according to a first embodiment is disposed in a vehicle, together with an internal-combustion engine 2.

The internal-combustion engine 2 is a gasoline reciprocating engine which outputs power from a crankshaft 2*b* by combusting a gasoline fuel 3 in plural cylinders 2*a*. The internal-combustion engine 2 may independently generate an output EP, which is power or horsepower, or may be a hybrid engine which produces the output EP with a motor generator. The gasoline fuel 3 combusted in the internal-combustion engine 2 may be motor gasoline which has a predetermined octane number, or may be motor gasoline mixed with, for example, bioethanol.

Figure 2:
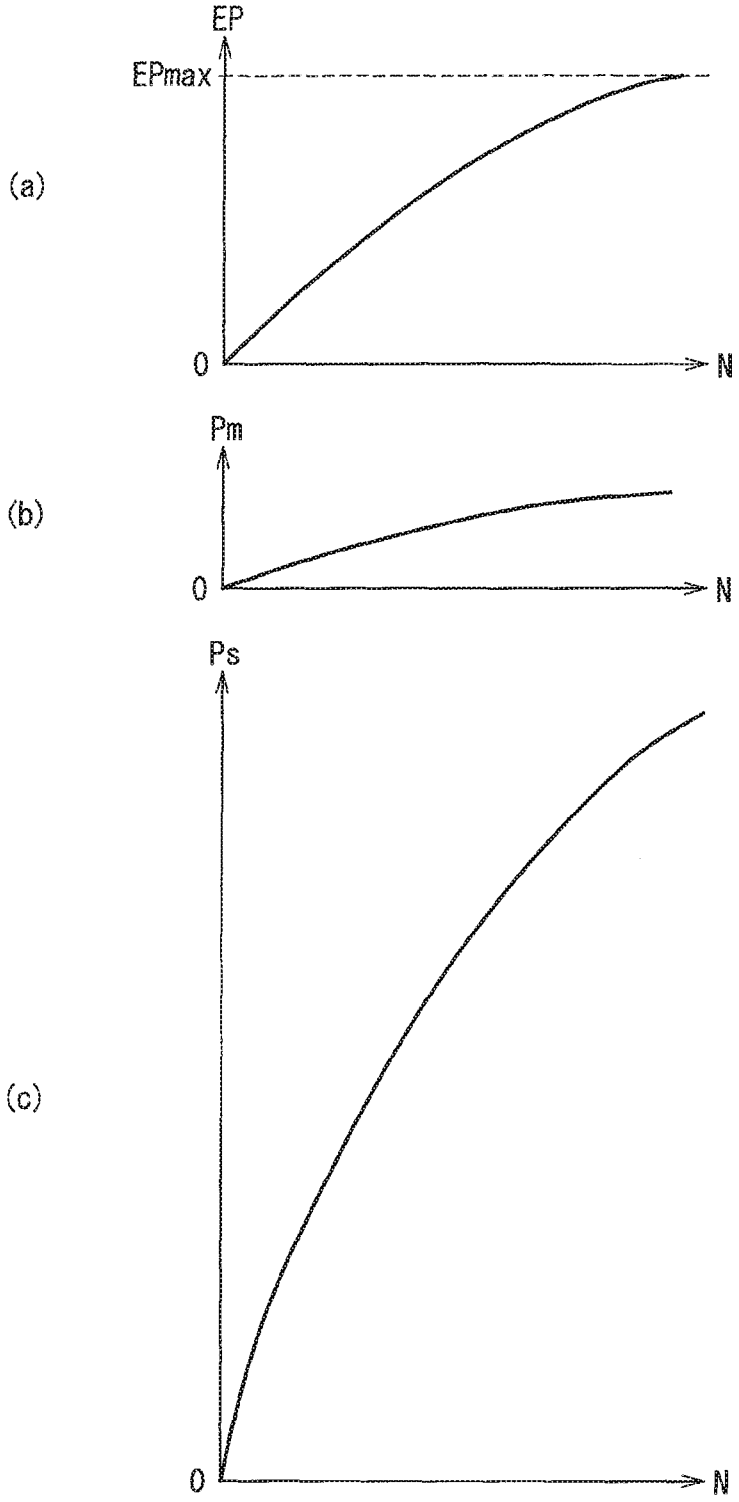
FIG. 2 is a characteristics view illustrating characteristics of the gasoline fuel supply system of the first embodiment and the internal-combustion engine.

The internal-combustion engine 2 has plural fuel injection valves 5, each of which directly injecting the gasoline fuel 3 to the respective cylinder 2*a*. Each of the fuel injection valves 5 is operated by electric power, and adjusts the injection quantity of the gasoline fuel 3 according to the operational status of the internal-combustion engine 2. The gasoline fuel 3 having a supply pressure Ps that is according to the operational status of the internal-combustion engine 2 is supplied to each of the fuel injection valves 5 through a high-pressure rail 6 of a vehicle. Here, as shown in (c) of FIG. 2, a demanded value of the supply pressure Ps to each of the fuel injection valves 5 changes according to the rotation speed N of the internal-combustion engine 2. Specifically, in an operating range lower than or equal to a maximum output EPmax of the internal-combustion engine 2, the demanded value of the supply pressure Ps is raised, as the rotation speed N is raised. Therefore, if the injection frequency of the gasoline fuel 3 from each of the fuel injection valves 5 is raised in response to the rotation speed N, an expected injection quantity can be secured by each of the fuel injection valves 5.

As shown in FIG. 1, the gasoline fuel supply system 1 is applied to the internal-combustion engine 2. The gasoline fuel supply system 1 pumps up the gasoline fuel 3 from the inside of the fuel tank 7 of the vehicle. Furthermore, the gasoline fuel supply system 1 supplies the pumped-up gasoline fuel 3 to each of the fuel injection valves 5 through the high-pressure rail 6. The gasoline fuel supply system 1 includes a feed pump part 10, an inline pump part 20, a high-pressure pump part 30, pressure passages 40-42, and an engine ECU (Electronic Control Unit) 50.

The feed pump part 10 includes a non-positive displacement electric pump 11 as a main component. The non-positive displacement electric pump 11 is a turbo type pump having an electric motor 110 to be supplied with electric power, and an impeller 112 rotated by the electric motor 110 in a pump casing 111 to operate the pump. At the operation time, the non-positive displacement electric pump 11 pumps the gasoline fuel 3 from the fuel tank 7 to an internal pump room 115 by suction from a suction port 113. Furthermore, at the operation time, the non-positive displacement electric pump 11 pressurizes the gasoline fuel 3 drawn to the pump room 115 with the impeller 112, and discharges the gasoline fuel from a discharge port 114. At this time, the non-positive displacement electric pump 11 discharges the pumped-up gasoline fuel 3 at the feed pressure Pt. The feed pressure Pf is set variably, for example, within a range of 300 to 500 kPa.

The non-positive displacement electric pump 11 is arranged inside the fuel tank 7 as an in-tank pump, and the suction port 113 is always soaked in the gasoline fuel 3 in the tank 7. Thereby, the self-suction from the suction port 113 is possible in the non-positive displacement electric pump 11 at the operation time when the impeller 112 rotates. Namely, the pumping of the gasoline fuel 3 is possible for the non-positive displacement electric pump 11 in the fuel tank 7. In contrast, when the impeller 112 is suspended, the gasoline fuel 3 is permitted to flow between the suction port 113 and the discharge port 114 in the non-positive displacement electric pump 11. A centrifugal pump such as swirl pump or turbine pump (diffuser pump) may be adopted as the non-positive displacement electric pump 11. In this embodiment, a cascade pump (wesco pump) is adopted, whose pressurization performance is higher than that of the centrifugal pump.

The feed pump part 10 has a fuel filter 12 in addition to the non-positive displacement electric pump 11. The fuel filter 12 is arranged in the fuel tank 7, and communicates with the discharge port 114 of the non-positive displacement electric pump 11. The gasoline fuel 3 discharged from the discharge port 114 passes through a filter element 120 such as filter paper or filter cloth, of the fuel filter 12 in the filter casing 121. Thereby, the filter element 120 catches a foreign substance contained in the gasoline fuel 3, while filtering the fuel 3.

The inline pump part 20 is communicated with the fuel filter 12 of the feed pump part 10 through the pressure passage 40. The gasoline fuel 3 discharged from the discharge port 114 of the non-positive displacement electric pump 11 in the feed pump part 10 flows into the inline pump part 20 through the fuel filter 12 and through the pressure passage 40.

The inline pump part 20 includes a non-positive displacement mechanical pump 21 as a main component. The non-positive displacement mechanical pump 21 is a turbo type pump, in which the impeller 212 is rotated in the pump casing 211, and operates in response to the output EP from the crankshaft 2*b* of the internal-combustion engine 2. At the operation time, the non-positive displacement mechanical pump 21 draws the gasoline fuel 3 discharged from the feed pump part 10 into the internal pump room 215 from the suction port 213. Furthermore, at the operation time, the non-positive displacement mechanical pump 21 pressurizes the gasoline fuel 3 drawn to the pump room 215 with the impeller 212, and discharges the pressurized fuel from the discharge port 214. At this time, the non-positive displacement mechanical pump 21 discharges the gasoline fuel 3 flowing from the feed pump part 10 at a middle pressure Pm. In this embodiment, as shown in (a) of FIG. 2, in the operating range below the maximum output EPmax of the internal-combustion engine 2, as the rotation speed N is raised, the output EP of the internal-combustion engine 2 increases. Therefore, as shown in (b) of FIG. 2, the middle pressure Pm is raised. That is, the middle pressure Pm is increased, as the supply pressure Ps demanded in response to the rotation speed N of the internal-combustion engine 2 becomes high. The middle pressure Pm is variably set within a range of, for example, 500 to 700 kPa, which is higher than the feed pressure Pf and lower enough than the supply pressure Ps.

As shown in FIG. 1, the non-positive displacement mechanical pump 21 is arranged outside the fuel tank 7, and the suction port 213 is communicated with the pressure passage 40. During the operation of the internal-combustion engine 2, the non-positive displacement mechanical pump 21 operates, and the non-positive displacement electric pump 11 also operates by being supplied with electric power. Therefore, at the operation time, in which the impeller 212 rotates, the non-positive displacement mechanical pump 21 is able to self-suction from the suction port 213. When the impeller 212 stops, the gasoline fuel 3 is permitted to flow between the suction port 213 and the discharge port 214, in the non-positive displacement mechanical pump 21. A centrifugal pump such as swirl pump or turbine pump may be adopted as the non-positive displacement mechanical pump 21. In this embodiment, a cascade pump whose pressurization performance is higher than that of a centrifugal pump is adopted, similarly to the non-positive displacement electric pump 11.

The inline pump part 20 has a middle relief valve 22 in addition to the non-positive displacement mechanical pump 21. The middle relief valve 22 is a one-way spring-type valve. The middle relief valve 22 is arranged outside the fuel tank 7, and communicates with a halfway point of the pressure passage 40 and with a halfway point of the pressure passage 41. Here, the discharge pressure of the gasoline fuel 3 discharged from the discharge port 214 is controlled to be lower than or equal to an upper limit pressure assumed as the middle pressure Pm, at a normal time, in the pressure passage 41 communicated with the discharge port 214. So, at a normal time when the discharge pressure from the discharge port 214 is lower than or equal to the upper limit pressure of the middle pressure Pm, the middle relief valve 22 is closed. As a result, the discharge pressure from the discharge port 214 is maintained at the middle pressure Pm in the pressure passage 41. In contrast, at an abnormal time when the discharge pressure from the discharge port 214 exceeds the upper limit pressure of the middle pressure Pm, the middle relief valve 22 is opened. As a result, the discharge pressure from the discharge port 214 is released to the pressure passage 40 where the pressure is lower than the pressure passage 41.

The high-pressure pump part 30 is communicated with the discharge port 214 of the non-positive displacement mechanical pump 21 of the inline pump part 20 through the pressure passage 41. The gasoline fuel 3 discharged from the discharge port 214 of the inline pump part 20 is received by the high-pressure pump part 30 through the pressure passage 41.

The high-pressure pump part 30 includes a positive displacement mechanical pump 31 as a main component. The positive displacement mechanical pump 31 is a plunger pump or piston pump which operates in response to receiving the output EP from the crankshaft 2*b* of the internal-combustion engine 2. A cam 8 receiving the output EP makes a movable component 312 to reciprocate in the pump housing 311. At the operation time, the positive displacement mechanical pump 31 draws the gasoline fuel 3 discharged from the inline pump part 20 from the suction port 313 to the internal pump room 315. Furthermore, at the operation time, the positive displacement mechanical pump 31 pressurizes the gasoline fuel 3 drawn to the pump room 315 by the movable component 312, and discharges the pressurized gasoline fuel from the discharge port 314. At this time, the positive displacement mechanical pump 31 discharges the gasoline fuel 3 flowing from the inline pump part 20 at the supply pressure Ps. In this embodiment, as shown in (a) of FIG. 2, in the operating range lower than or equal to the maximum output EPmax of the internal-combustion engine 2, as the rotation speed N is raised, the output EP of the internal-combustion engine 2 increases. Therefore, as shown in (c) of FIG. 2, the supply pressure Ps is raised to fulfill the demanded value. The supply pressure Ps is variably set within a range of, for example, 15 to 30 MPa, which is higher enough than the feed pressure Pf and the middle pressure Pm.

As shown in FIG. 1, the positive displacement mechanical pump 31 is arranged outside the fuel tank 7, and the suction port 313 is communicated with the pressure passage 41. Further, the discharge port 314 of the positive displacement mechanical pump 31 is communicated with the pressure passage 42. The pressure passage 42 is communicated with the high-pressure rail 6. Therefore, at a time of downward operation when the movable component 312 moves downward in the pump room 315, the positive displacement mechanical pump 31 is able to self-suction from the suction port 313. At a time of rise operation when the movable component 312 moves upward in the pump room 315, the positive displacement mechanical pump 31 is able to discharge the high pressure from the discharge port 314.

The high-pressure pump part 30 has a suction damper 32, a suction valve 33, and a discharge valve 34 in addition to the positive displacement mechanical pump 31. The suction damper 32 is a pulsation damper such as a diaphragm type. The suction damper 32 is arranged outside the fuel tank 7, and is attached, for example, to the positive displacement mechanical pump 31. The suction damper 32 is communicated with a halfway point of the pressure passage 41. The suction damper 32 controls fuel pressure pulsation of the gasoline fuel 3 in the pressure passage 41.

The suction valve 33 is a solenoid valve which operates in response to a passage of electricity. The suction valve 33 is attached, for example, to the positive displacement mechanical pump 31, outside the fuel tank 7, and is located to be able to intercept the communication between the suction port 313 and the pump room 315. The suction valve 33 is opened by stopping the power supply when the movable component 312 moves downward. As a result, because the communication is made possible between the suction port 313 and the pump room 315, the gasoline fuel 3 is drawn from the suction port 313 to the pump room 315. When the movable component 312 moves upward, the suction valve 33 is closed in response to the power supply. As a result, the gasoline fuel 3 is pressurized in the pump room 315, because of the interception between the suction port 313 and the pump room 315.

The discharge valve 34 is a one-way spring-type valve. The discharge valve 34 is arranged outside the fuel tank 7, and is arranged at a halfway point of the pressure passage 42, or at the discharge port 314 of the positive displacement mechanical pump 31 (FIG. 1 illustrates an example where the discharge valve 34 is arranged at the halfway point of the pressure passage 42). Here, the discharge valve 34 is set to open when a pressure difference between the upstream and the downstream of the discharge valve 34 becomes about 20 kPa. Thereby, when the movable component 312 is moved upward, the gasoline fuel 3 having the supply pressure Ps is pushed out of the pump room 315 to the discharge port 314, such that the discharge valve 34 is opened. As a result, the gasoline fuel 3 discharged at the supply pressure Ps from the discharge port 314 is supplied to the high-pressure rail 6 through the pressure passage 42, and is further supplied to each of the fuel injection valves 5. When the discharge of the gasoline fuel 3 from the discharge port 314 of the positive displacement mechanical pump 31 stops, the discharge valve 34 is closed to regulate the adverse current to the pump room 315 through the port 314.

Components of each of the high-pressure pump part 30 and the inline pump part 20 are configured integrally, in this embodiment, with a part of the pressure passage 40, 42, and whole of the pressure passage 41. Therefore, the high-pressure pump part 30 and the inline pump part 20 can be easily mounted around the internal-combustion engine 2 in a vehicle. Alternatively, the high-pressure pump part 30 and the inline pump part 20 may be formed separately.

Moreover, in this embodiment, a high-pressure relief valve 9 is disposed in the high-pressure rail 6. The high-pressure relief valve 9 is a one-way spring-type valve. The high-pressure relief valve 9 is arranged outside the fuel tank 7, and communicates with a halfway point between the high-pressure rail 6 and the pressure passage 41. At a normal time, the fuel pressure of the gasoline fuel 3 accumulated in the high-pressure rail 6 is controlled to be lower than or equal to an upper limit pressure assumed relative to the supply pressure Ps. So, at the normal time when the fuel pressure in the high-pressure rail 6 is lower than or equal to the upper limit pressure of the supply pressure Ps, the high-pressure relief valve 9 is closed. As a result, the fuel pressure in the high-pressure rail 6 is maintained at the supply pressure Ps. At an abnormal time when the fuel pressure in the high-pressure rail 6 exceeds the upper limit pressure of the supply pressure Ps, the high-pressure relief valve 9 is opened. As a result, the fuel pressure in the high-pressure rail 6 is released to the pressure passage 41 where the pressure is lower than that in the rail 6.

The engine ECU 50 includes, as a main component, a microcomputer, and is arranged outside of the fuel tank 7. The engine ECU 50 is electrically connected to an electronic part such as the fuel injection valve 5 of the internal-combustion engine 2. Furthermore, the engine ECU 50 is electrically connected also to the non-positive displacement electric pump 11 and the suction valve 33. The engine ECU 50 controls the electric power supplied to the electronic part such as the fuel injection valve 5 of the internal-combustion engine 2, and the non-positive displacement electric pump 11 and the suction valve 33.

In the gasoline fuel supply system 1, when the power switch of the vehicle is turned ON, the engine ECU 50 starts the control. Then, the non-positive displacement electric pump 11 starts operating, and the internal-combustion engine 2 starts operating such that the non-positive displacement mechanical pump 21 and the positive displacement mechanical pump 31 also start operating. As a result, the gasoline fuel 3 is pumped up from the inside of the fuel tank 7 by the non-positive displacement electric pump 11, and is pressurized by the non-positive displacement mechanical pump 21 from the feed pressure Pf to the middle pressure Pm. Then, the gasoline fuel 3 is further pressurized by the positive displacement mechanical pump 31 to the supply pressure Ps. In this way, the gasoline fuel 3 in which the fuel pressure is raised to the supply pressure Ps is once accumulated in the high-pressure rail 6, and is supplied to each of the fuel injection valves 5 at the time of injection to the corresponding cylinder 2*a*.

Hereafter, the operation and advantage of the first embodiment is explained.

According to the first embodiment, the inline pump part 20 pressurizes the gasoline fuel 3 discharged from the feed pump part 10, and discharges the fuel at the middle pressure Pm. The high-pressure pump part 30 further pressurizes the gasoline fuel 3 discharged from the inline pump part 20, and discharges the fuel at the supply pressure Ps to each of the fuel injection valves 5. Therefore, the inline pump part 20 can raise the middle pressure Pm at the low-pressure side of the high-pressure pump part 30, while the feed pressure Pf of the gasoline fuel 3 pumped from the fuel tank 7 is restricted to be lower in the feed pump part 10. The feed pump part 10 has the non-positive displacement electric pump 11 which operates in response to receiving electric power, and the inline pump part 20 has the non-positive displacement mechanical pump 21 which operates in response to the output EP of the internal-combustion engine 2. Therefore, the power consumption can be reduced when supplying electric power to the non-positive displacement electric pump 11 in the feed pump part 10 where the feed pressure Pf is restricted to be lower, and the vaporization of the gasoline fuel 3 can be controlled in the inline pump part 20, because the non-positive displacement mechanical pump 21 uses the output EP of the internal-combustion engine 2. Thus, the fuel injection characteristic can be secured while the energy can be saved.

Moreover, in the first embodiment, both the non-positive displacement electric pump 11 and the non-positive displacement mechanical pump 21 are cascade pumps. Generally, the sliding resistance is smaller at the non-positive displacement electric pump 11 and the non-positive displacement mechanical pump 21, compared with a positive displacement pump such as a trochoid pump. Therefore, the power consumption or the output consumption for operating the pumps 11, 21 can be reduced. Therefore, high energy-saving property can be demonstrated.

If the non-positive displacement electric pump 11 breaks down in the feed pump part 10, the inline pump part 20 is able to supply the gasoline fuel 3 from the fuel tank 7 through the broken-down non-positive displacement electric pump 11 to the high-pressure pump part 30. Conversely, if the non-positive displacement mechanical pump 21 breaks down in the inline pump part 20, the gasoline fuel 3 discharged from the non-positive displacement electric pump 11 in the feed pump part 10 can be supplied to the high-pressure pump part 30 through the broken-down non-positive displacement mechanical pump 21. Therefore, the fail-safe system can be secured.

As mentioned above, in the first embodiment, the fuel injection characteristic, the energy-saving and the fail-safe can be secured.

According to the first embodiment, when the discharge pressure of the non-positive displacement mechanical pump 21 exceeds the upper limit pressure set for the middle pressure Pm, the discharge pressure is released by the middle relief valve 22 in the inline pump part 20. Therefore, during the operation of the internal-combustion engine 2, in which the non-positive displacement mechanical pump 21 operates, an abnormality that the middle pressure Pm exceeding the upper limit pressure can be restricted from being generated at the low-pressure side of the high-pressure pump part 30. Moreover, at a time of dead soak when the non-positive displacement mechanical pump 21 and the internal-combustion engine 2 are left in the halt condition, at the low-pressure side of the high-pressure pump part 30 which receives heat from the internal-combustion engine 2, the fuel pressure may rise due to a rise in temperature of the gasoline fuel 3. However, at a time of the dead soak, at the low-pressure side of the high-pressure pump part 30, if the fuel pressure corresponding to the discharge pressure of the non-positive displacement mechanical pump 21 exceeds the upper limit pressure of the middle pressure Pm, the fuel pressure can be released by the middle relief valve 22. Thus, the resistance to pressure can be secured at a time of the dead soak during operation of the internal-combustion engine 2.

Furthermore, according to the first embodiment, as the supply pressure Ps required in response to the rotation speed N of the internal-combustion engine 2 becomes higher, the middle pressure Pm is raised by the non-positive displacement mechanical pump 21 in the inline pump part 20. Thereby, the feed pressure Pf can be restricted low in the feed pump part 10 including the non-positive displacement electric pump 11, and the middle pressure Pm can be raised in the inline pump part 20 including the non-positive displacement mechanical pump 21, such that the supply pressure Ps required to be higher can be met by the high-pressure pump part 30. Therefore, when the internal-combustion engine 2 is rotated at high speed, not only the energy-saving can be secured, but also an expected fuel injection characteristic can be secured by the high supply pressure Ps.

According to the first embodiment, in the feed pump part 10, the gasoline fuel 3 is pumped by the non-positive displacement electric pump 11 inside the fuel tank 7. Since the non-positive displacement electric pump 11 is immersed in the fuel in the fuel tank 7, it become easy to self-suction the gasoline fuel 3 while the non-positive displacement electric pump 11 is generally low in the self-suction ability. Therefore, the non-positive displacement electric pump 11 can be operated while the fuel injection characteristic, the energy-saving and the fail-safe are secured.

According to the first embodiment, the gasoline fuel 3 having the feed pressure Pf and discharged from the non-positive displacement electric pump 11 is filtered with the fuel filter 12 in the feed pump part 10. At this time, since the feed pressure Pf is restricted low in the feed pump part 10, the resistance specification to pressure required for the fuel filter 12 can be lowered.

Second Embodiment

Figure 3:
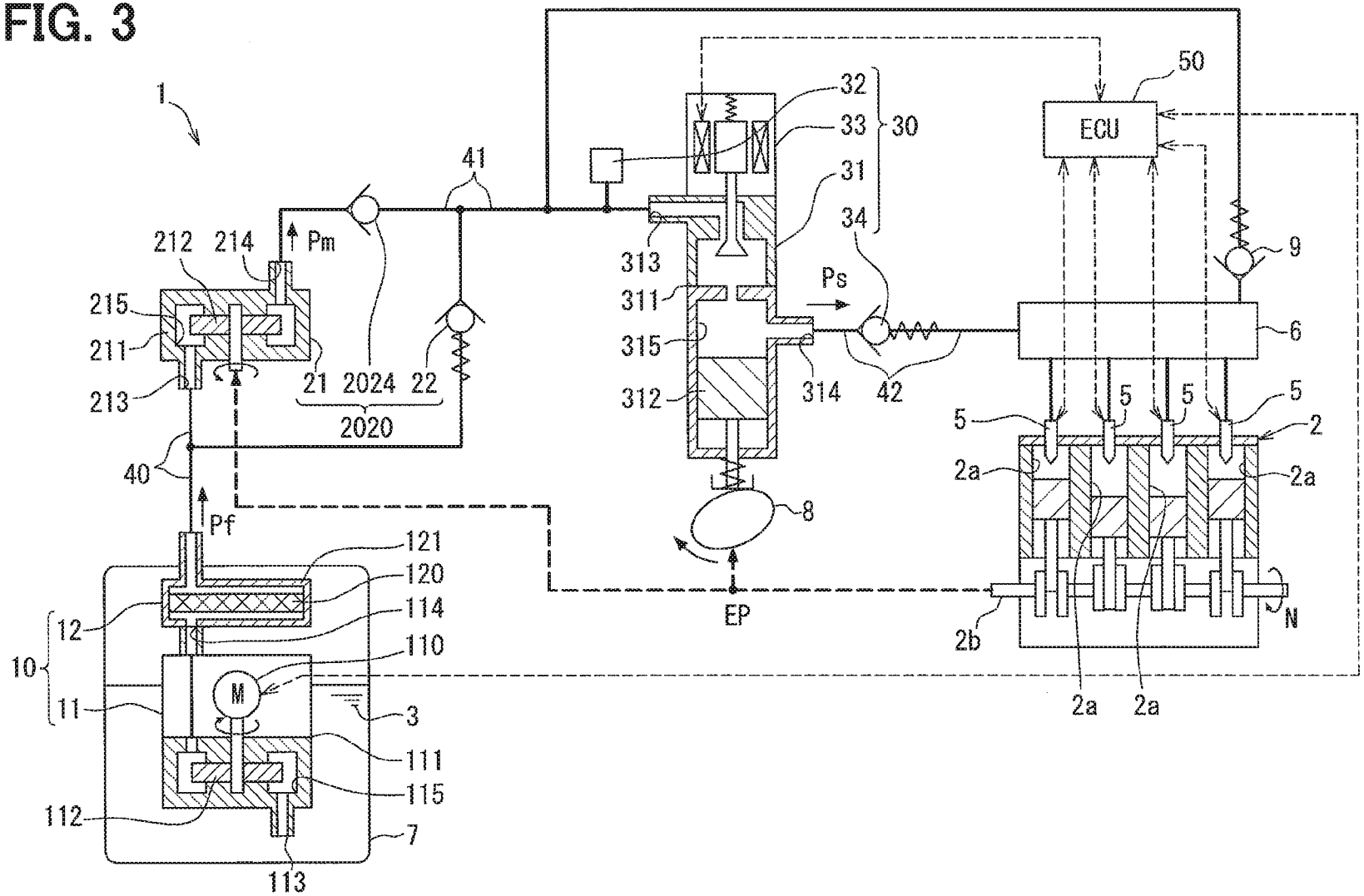
FIG. 3 is a diagram illustrating a gasoline fuel supply system according to a second embodiment.

As shown in FIG. 3, a second embodiment is a modification of the first embodiment. The inline pump part 2020 of the second embodiment has a check valve 2024 in addition to the non-positive displacement mechanical pump 21 and the middle relief valve 22 which are approximately the same as those in the first embodiment.

The check valve 2024 is a one-way springless valve. The check valve 2024 is arranged outside the fuel tank 7, and is arranged at a halfway point of the pressure passage 41, or at the discharge port 214 of the non-positive displacement mechanical pump 21 (FIG. 3 illustrates an example where the check valve 2024 is arranged at the halfway part of the pressure passage 41). Here, the check valve 2024 is set to open when a pressure difference between the upstream side and the downstream side becomes about 20 Pa. Thereby, the check valve 2024 is opened by the gasoline fuel 3 having the middle pressure Pm being pushed out of the pump room 215 of the non-positive displacement mechanical pump 21 to the discharge port 214. As a result, the gasoline fuel 3 discharged at the middle pressure Pm is supplied to the positive displacement mechanical pump 31 of the high-pressure pump part 30 through the pressure passage 41 from the discharge port 214. Further, in the inline pump part 2020, the gasoline fuel 3 at the middle pressure Pm is supplied also to the middle relief valve 22 communicated with the pressure passage 41 at the downstream of the check valve 2024. Therefore, at an abnormal time when the fuel pressure of the gasoline fuel 3 exceeds the upper limit pressure of the middle pressure Pm in the pressure passage 41, the middle relief valve 22 achieves the releasing function. As the result, when the fuel pressure is lowered, the function will stop. When the discharge of the gasoline fuel 3 stops from the discharge port 214 of the non-positive displacement mechanical pump 21, the check valve 2024 is closed to regulate the adverse current to the pump room 215 through the port 214.

According to the second embodiment, the adverse current of the gasoline fuel 3 discharged from the non-positive displacement mechanical pump 21 in the inline pump part 2020 is regulated by the check valve 2024. Therefore, at a time of the dead soak in which the internal-combustion engine 2 and the non-positive displacement mechanical pump 21 are left in the halt condition, the vaporization of the gasoline fuel 3 can be controlled by maintaining the fuel pressure at the middle pressure Pm, at the low-pressure side of the high-pressure pump part 30 which receives heat from the internal-combustion engine 2. Therefore, the fuel injection characteristic can be secured in the internal-combustion engine 2 which starts operation after the dead soak.

According to the second embodiment, similarly to the first embodiment, at a time of the dead soak, if the fuel pressure at the low pressure side of the high-pressure pump part 30 exceeds the upper limit pressure of the middle pressure Pm, the fuel pressure can be released by the middle relief valve 22. Further, at the low-pressure side of the high-pressure pump part 30, after the releasing function stops by lowering in the fuel pressure, the fuel pressure can be held at the middle pressure Pm by the adverse current regulation function of the check valve 2024. Accordingly, the resistance to pressure can be secured at the time of dead soak, and the fuel injection characteristic can be secured at a starting time after the dead soak.

Other Embodiment

It should be appreciated that the present disclosure is not limited to the embodiments described above and can be applied to various embodiments and the combination within the scope of the present disclosure.

Figure 4:
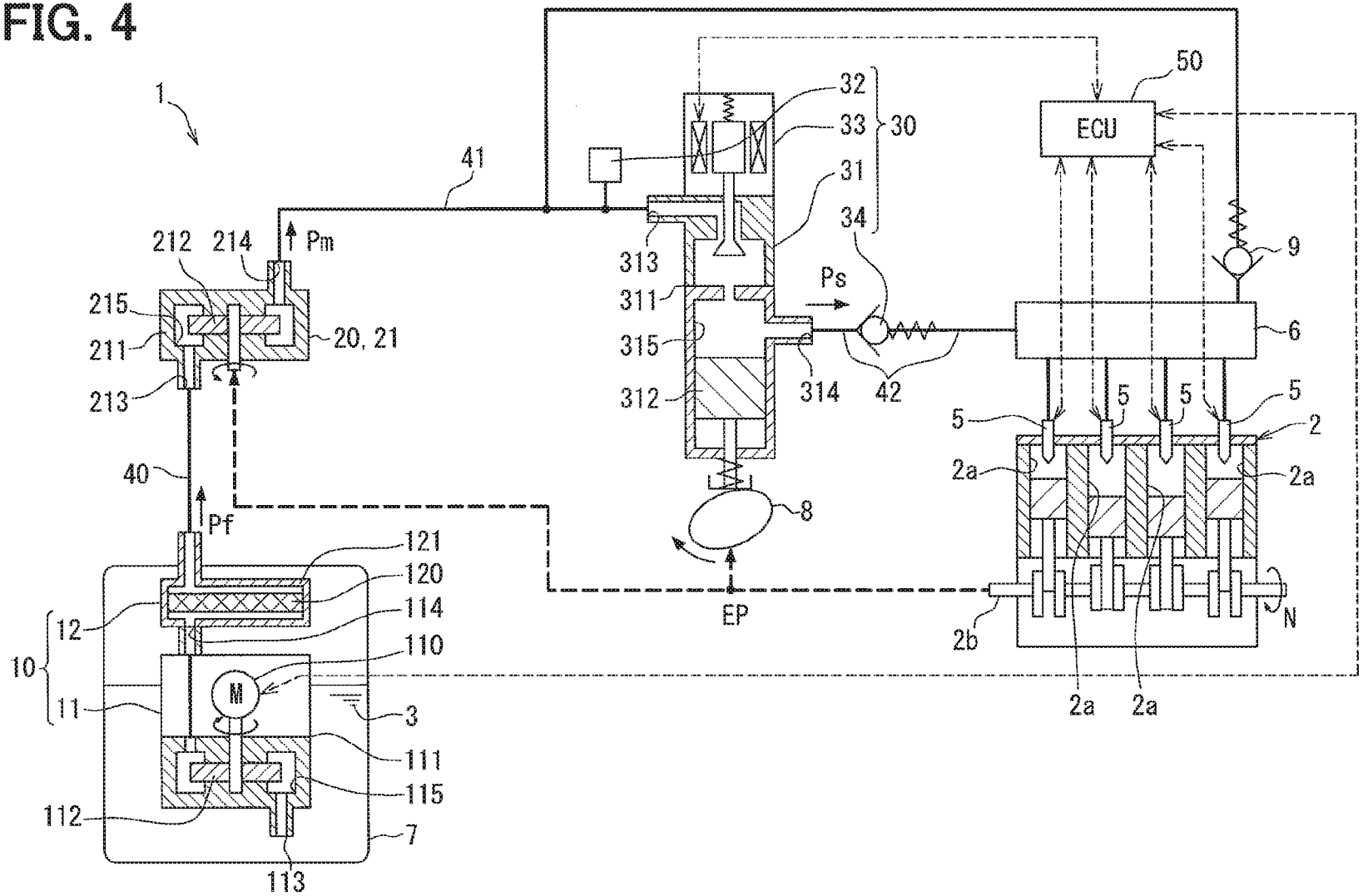
FIG. 4 is a diagram illustrating a modification of FIG. 1.
Figure 5:
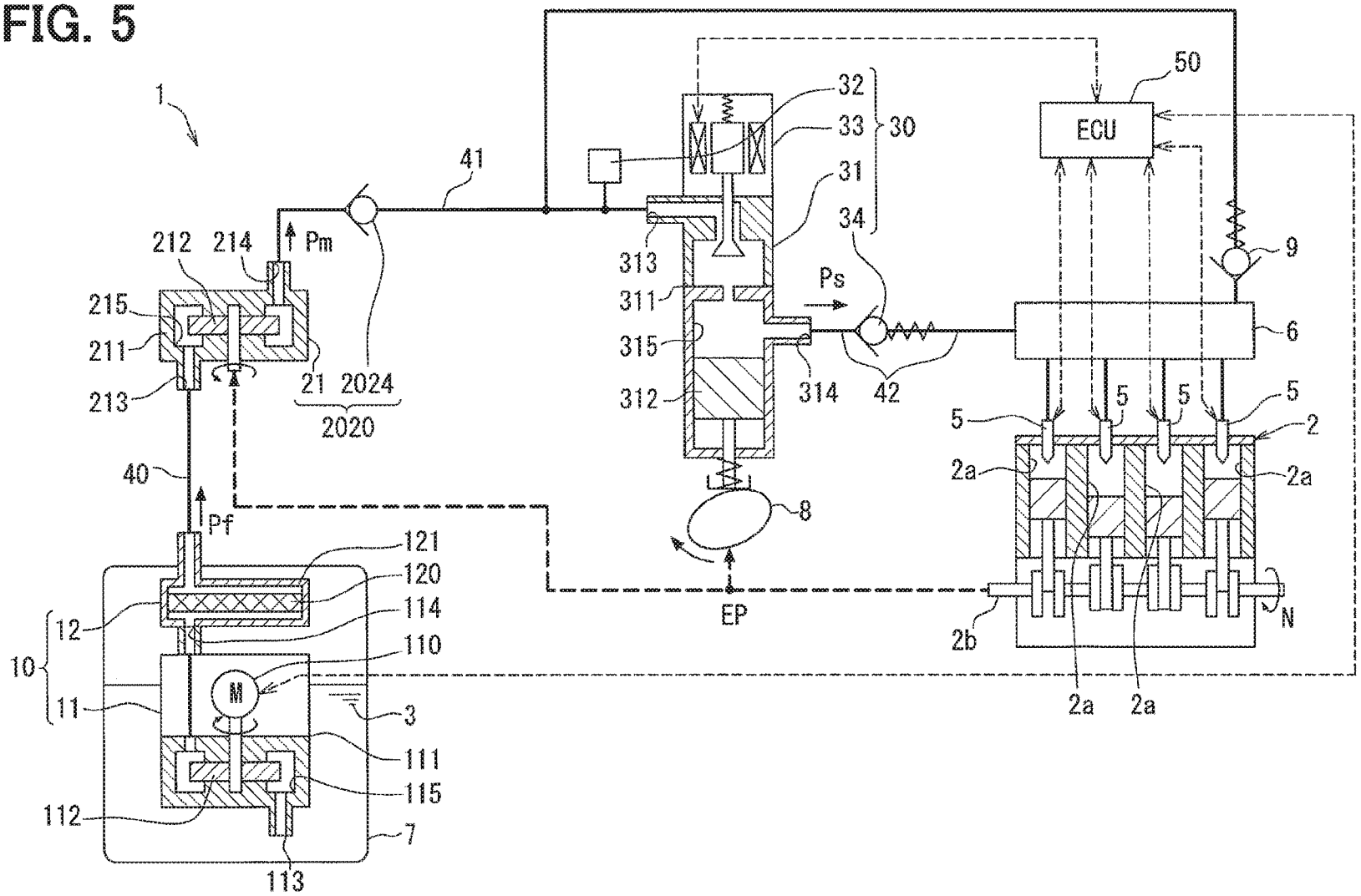
FIG. 5 is a diagram illustrating a modification of FIG. 3.

Specifically, in a first modification of the first embodiment, as shown in FIG. 4, the middle relief valve 22 may be eliminated. Similarly, as shown in FIG. 5, in a second modification of the second embodiment, the middle relief valve 22 may be eliminated.

Figure 6:
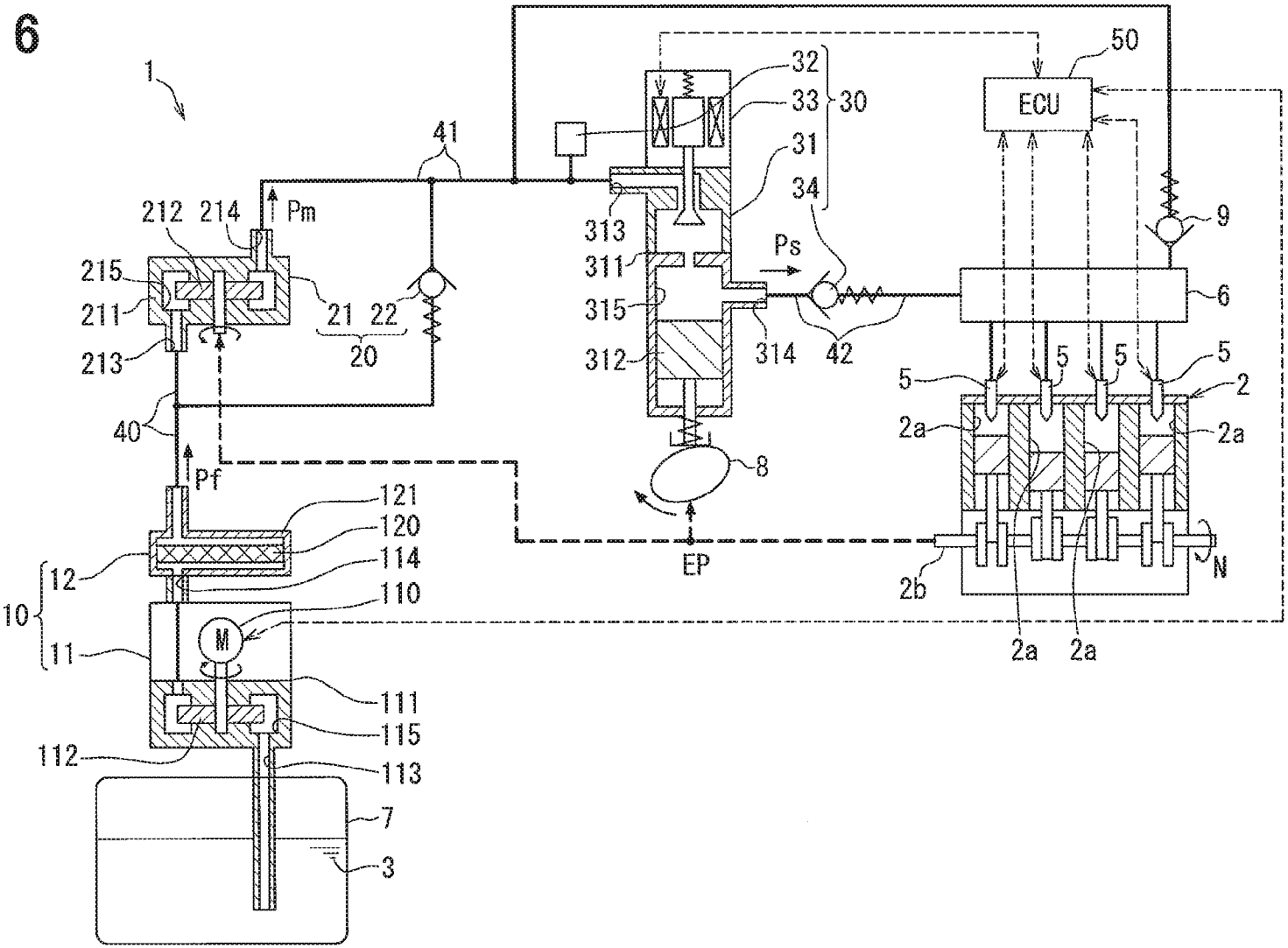
FIG. 6 is a diagram illustrating a modification of FIG. 1.
Figure 7:
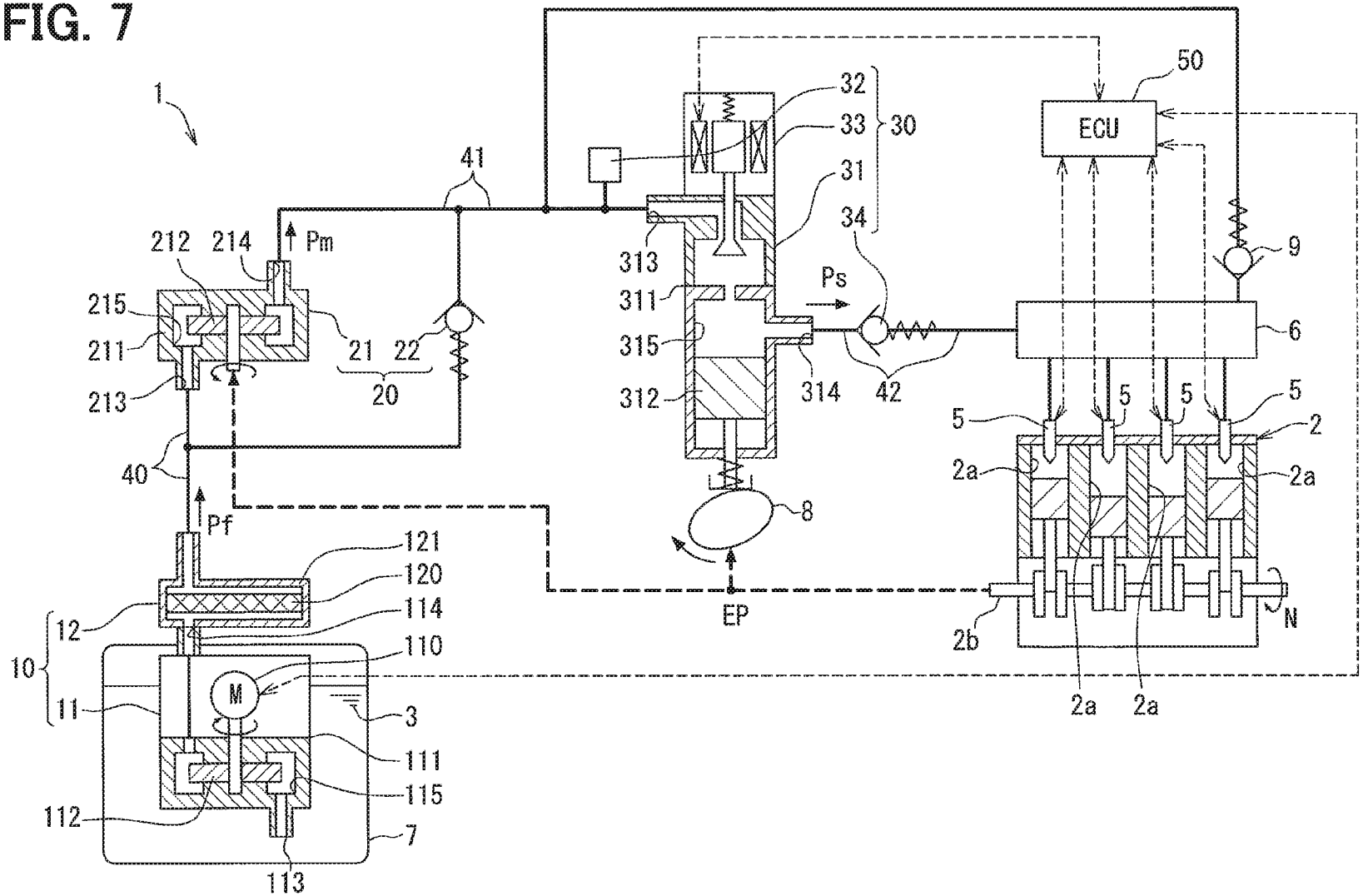
FIG. 7 is a diagram illustrating a modification of FIG. 1.

In a third modification of the first and the second embodiments, as shown in FIG. 6, the non-positive displacement electric pump 11 may be located outside the fuel tank 7. Moreover, in a fourth modification of the first and second embodiment, as shown in FIGS. 6 and 7, the fuel filter 12 may be located outside the fuel tank 7. In addition, FIG. 6 illustrates the third modification of the first embodiment, and FIG. 7 illustrates the fourth modification of the first embodiment.

In a fifth modification of the first and second embodiments, the fuel filter 12 may be eliminated. In a sixth modification of the first and second embodiments, an operating range may be defined where the middle pressure Pm is not raised when the supply pressure Ps demanded in response to the rotation speed N of the internal-combustion engine 2 becomes high.

The invention claimed is:

1. A gasoline fuel supply system that supplies a gasoline fuel to a fuel injection valve by pumping from a fuel tank so as to be directly injected by the fuel injection valve into a cylinder of an internal-combustion engine, the gasoline fuel supply system comprising:

a feed pump part including a non-positive displacement electric pump which operates in response to receiving electric power, and pumping the gasoline fuel from the fuel tank and discharging at a feed pressure;

an inline pump part including a non-positive displacement mechanical pump which operates in response to receiving an output of the internal-combustion engine, and pressurizing the gasoline fuel discharged from the feed pump part and discharging at a middle pressure; and a high-pressure pump part including a positive displacement mechanical pump which operates in response to receiving the output of the internal-combustion engine, and pressurizing the gasoline fuel discharged from the inline pump part and discharging at a supply pressure to the fuel injection valve.

2. The gasoline fuel supply system according to claim 1, wherein the inline pump part has a check valve which regulates an adverse current of the gasoline fuel discharged from the non-positive displacement mechanical pump.

3. The gasoline fuel supply system according to claim 1, wherein the inline pump part has a relief valve which releases a discharge pressure of the non-positive displacement mechanical pump, when the discharge pressure exceeds an upper limit pressure assumed relative to the middle pressure.

4. The gasoline fuel supply system according to claim 1, wherein the non-positive displacement mechanical pump of the inline pump part raises the middle pressure, as the supply pressure, which is demanded in response to a rotation speed of the internal-combustion engine, is raised.

5. The gasoline fuel supply system according to claim 1, wherein the non-positive displacement electric pump located inside the fuel tank pumps the gasoline fuel in the feed pump part.

6. The gasoline fuel supply system according to claim 1, wherein the feed pump part has a fuel filter filtering the gasoline fuel discharged from the non-positive displacement electric pump.

* * * * *